US005139369A

United States Patent [19]

Jaecklin

[11] Patent Number: 5,139,369

[45] Date of Patent: Aug. 18, 1992

[54] WALL WITH GRAVITY SUPPORT STRUCTURE, BUILDING ELEMENT AND METHOD FOR CONSTRUCTION THEREOF

[76] Inventor: Felix P. Jaecklin, Geissbergstr. 46, CH-5400 Ennetbaden, Switzerland

[21] Appl. No.: 463,258

[22] Filed: Jan. 9, 1990

Related U.S. Application Data

[63] Continuation-in-part of Ser. No. 301,386, Jan. 25, 1989, Pat. No. 4,930,939, which is a continuation-in-part of Ser. No. 904,643, Sep. 8, 1986, Pat. No. 4,818,150.

[51] Int. Cl.[5] ..... F02D 29/02

[52] U.S. Cl. ..... 405/262; 405/258; 405/284

[58] Field of Search ..... 405/284, 285, 286, 287, 405/273, 262, 258

[56] References Cited

U.S. PATENT DOCUMENTS

| | | | |
|---|---|---|---|
| 4,154,554 | 5/1979 | Hilfiker | 405/223 |
| 4,343,571 | 8/1982 | Price | 405/284 |
| 4,557,634 | 12/1985 | Vidal | 405/284 X |
| 4,661,023 | 4/1985 | Hilfiker | 405/284 X |
| 4,671,706 | 6/1987 | Giardini | 405/286 |

FOREIGN PATENT DOCUMENTS

| | | | |
|---|---|---|---|
| 251317 | 9/1912 | Fed. Rep. of Germany | 405/284 |
| 0134969 | 4/1979 | German Democratic Rep. | 405/284 |
| 0089536 | 7/1980 | Japan | 405/284 |
| 7904901 | 12/1980 | Netherlands | 405/284 |
| 2073281 | 10/1981 | United Kingdom | 405/284 |

*Primary Examiner*—Dennis L. Taylor
*Attorney, Agent, or Firm*—Lalos & Keegan

[57] ABSTRACT

A retaining wall including a forepart with a plurality of support elements arranged on vertically successive levels. At least one of the support elements has a front face covered by a section of flexible envelope material which extends out of bulk material filling a support structure located in the rear of the forepart. At least one anchoring element is embedded in the bulk material.

13 Claims, 7 Drawing Sheets

WALL WITH GRAVITY SUPPORT STRUCTURE, BUILDING ELEMENT AND METHOD FOR CONSTRUCTION THEREOF

RELATED APPLICATIONS

This application is a continuation-in-part of U.S. application Ser. No. 301,386, filed Jan. 25, 1989 now U.S. Pat. No. 4,930,939, which is a continuation-in-part of U.S. application Ser. No. 904,643, filed Sep. 8, 1986, now U.S. Pat. No. 4,818,150.

BACKGROUND OF THE INVENTION

Walls constructed as a gravity support structure with bulk material cells enveloped by flexible flat material such as foils or tissue of synthetic resins or plastic material are well known. They are in use particularly for supporting slopes. The front side of such a gravity support structure generally is formed by the front portions of the bulk material compartments or cells, i.e. by the front portions of the envelopes, which stand under the internal pressure of the bulk material filling and which form convex vaults. The bulk material cells superimposed on each other are in mutual positive or at least frictional, shear resistant connection. This results in an enhanced stability and support capability, especially against the horizontally acting pressure component of a slope located behind the gravity support structure. Due to their simple production and reduced expense there is an increasing demand for the application of such structures.

However, there are problems due to the envelope material being susceptible to piercing or tearing with the consequence of the bulk material running out and leaving the structure unstable. Further, difficulties arise from the sensitiveness of the envelope material against solar irradiation. Providing an earth slope in contact with the front of the structure, which could shield the envelope against irradiation and facilitate planting, generally is difficult in view of poor connection between the smooth surface of the envelope material and the earth of the slope. This leads to separation due to natural settling of the earth and to undesired exposition of the envelope material.

SUMMARY OF THE INVENTION

It is an object of the invention to create a wall construction comprising a gravity support structure with a plurality of cells which are filled with bulk material and surrounded or subdivided by flat and flexible envelope material, in which the front faces of said compartments and particularly the exposed portions of the envelope material are efficiently protected, whilst the advantages concerning stability and inexpensive production are preserved, particularly in the case of constructions with comparatively steep front faces.

This object is achieved by a wall construction comprising a gravity support structure with a plurality of cells which are filled with bulk material and surrounded or subdivided by flat and flexible envelope material, the wall being provided with at least one forepart which is positively or frictionally connected with said gravity support structure at least with regard to horizontal forces acting between said forepart and said gravity support structure.

The structure offers essential advantages over the usually designed walls merely consisting of a supporting grid composed of frame-like elements. A major part of the structure volume and weight required to provide the tilting resistance or slope supporting capability can be realized by the gravity support structure and can be much less expensive. The foreparts make it possible to provide a front face structured by ribs and recesses so as to offer the best noise absorption and to form receptacles for earth to bear plants, particularly in the case of a grid support structure filled with earth as forepart.

Due to the gravity support structure taking over a great part of the stabilizing function the foreparts can be reduced considerably as to their dimensions, especially their wall thickness, and accordingly to the expenses.

For the purpose of anchoring the foreparts to the gravity support structure, preferably appropriate portions of the envelope material already present in the gravity support structure may be used. In the case of a stand-alone wall with two foreparts on opposite front sides of a centrally located gravity support structure, stability may be further enhanced substantially without additional expense by connecting the opposite foreparts or certain building elements thereof, which preferably are located on proximate levels, directly with each other by means of tensile anchoring elements extending through the central gravity support structure.

Specific solutions to the aforesaid problems according to the present invention are defined by the features of claims 1, 2, 3, 5, 8 and 11.

The invention will be further explained with reference to the enclosed drawings, wherein specific embodiments thereof are shown.

DETAILED DESCRIPTION OF THE INVENTION

Figure 1:
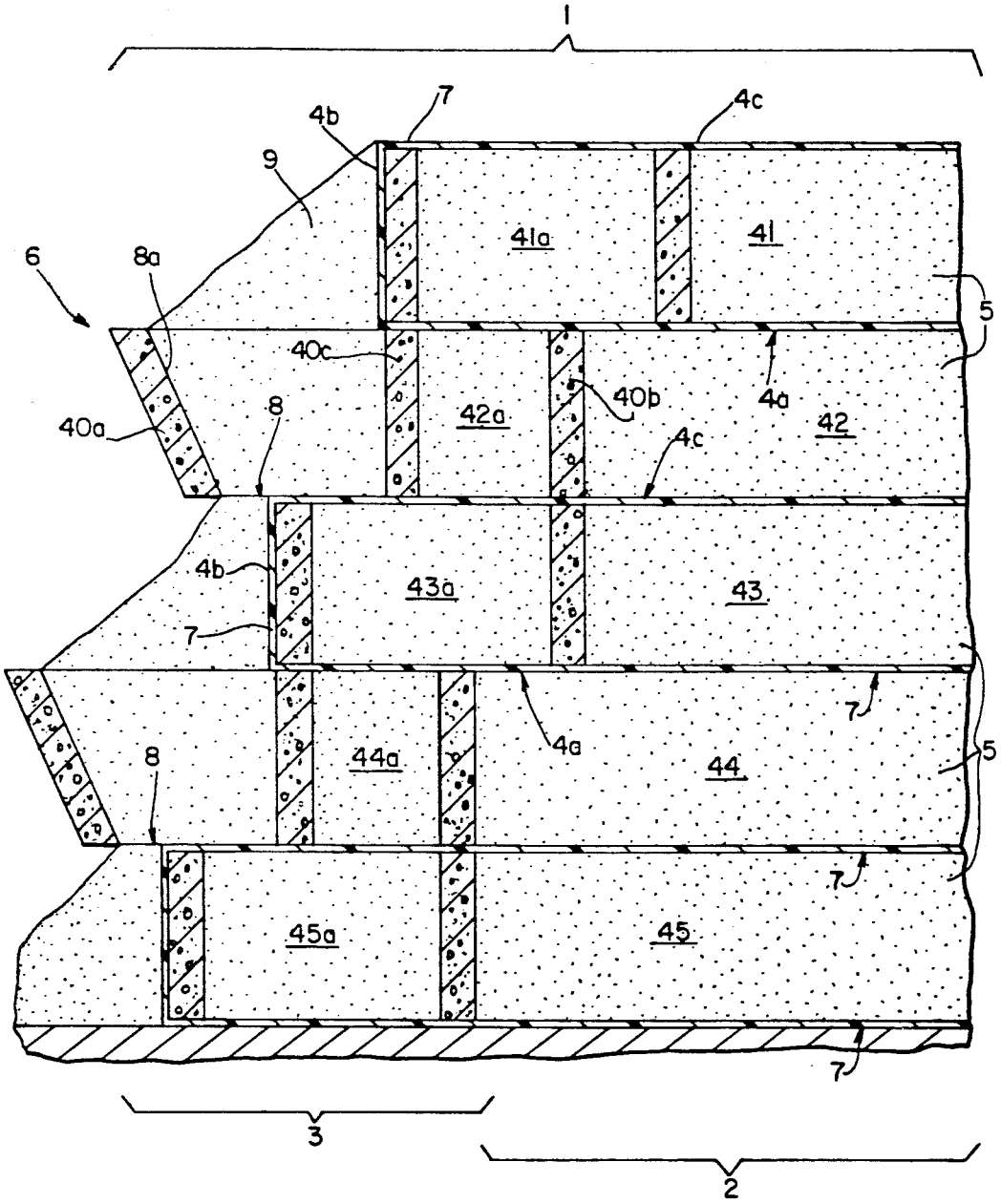
FIG. 1 is a vertical cross-sectional view of an embodiment of a slope supporting wall.

The invention now will be explained in detail with reference to the examples schematically shown in the drawings. FIG. 1 illustrates in a vertical cross-section a wall 1 comprising a support structure 2 and a forepart 3. The support structure 2 includes a plurality of vertically arranged compartments 41 to 45 filled with bulk material 5. As shown for the compartment 41 only, these compartments have a bottom face 4a, a front face 4b oriented towards the front 6 of the wall and an upper face 4c. The front, bottom and upper faces of compartments 41, 43 and 45 are defined by flexible envelope material 7 extending along said faces. Only the bottom and upper faces of compartments 42 and 44 are likewise defined by flexible envelope material, while the front faces have been left free. The forepart 3 comprises a plurality of support elements 41a to 45a arranged one above the other. They have also bottom, front and upper faces as evident from the illustration. The flexible envelope material defining the faces of compartments 41, 43 and 45 is elongated so as to cover the front faces of support elements 41a, 43a and 45a also.

In comparison with known walls, the front faces of which are formed substantially by front sections of flexible envelopes filled with bulk material, one of the advantages realized by the structure just described is the enhanced stability and rigidity of the front structure and, thereby, the enhanced supporting capability of the wall acting against the gravity pressure of earth and boulder material behind the wall.

A further major feature of the wall as just described has to be recognized in that there are differently arranged first and second support elements. The first ones are said elements 41a and 43a, the front faces of which are surrounded and covered by a section of flexible envelope material 7 extending out of the bulk material behind the forepart. The second ones are said elements 42a and 44a, each of which is arranged beneath one of the said first support elements and in supporting connection therewith. The front faces of said second support elements are left free of flexible envelope material and shaped so as to project in direction towards the front 6 of the wall beyond the corresponding first support element arranged thereabove. Each of those second support elements forms a bearing surface 8 for a bulk material forefilling 9 covering at least partly the front face of said first support element arranged thereabove.

While supporting capability for many applications is not too much diminished by omitting the anchoring-by-envelopement effect for each second one of said support elements arranged one above the other, a substantial advantage is the covering of the front sections of the flexible envelope material by the said bulk material forefilling. This shields the flexible material, mostly consisting of plastics, from deterioration by ultraviolet irradiation. Furthermore, the slope surfaces formed by the forefilling offers sufficient basis for various plants as desired in view of landscape architecture.

A further important feature of the wall structure shown in FIG. 1 is based on the specific design of the support elements, such as elements 42a and 44a arranged therein. These elements comprise a front board section 40a extending in a direction along the front face of the wall. This board section forms an additional bearing surface 8a for bulk material, which together with the basic bearing surface 8 explained above offers an enhanced root space for plants and secures the bulk material filling against erosion. Further there is a rear support section 40b extending in vertical direction so as to form bearing connections with the adjacent wall elements. An intermediate support section 40c also extending in vertical direction so as to form bearing connections with the adjacent wall elements. This double supporting connection by two support sections offset against each other in horizontal direction secures the elements positively against tilting and thus enhances the overall wall stability. It has to be understood that in view of heavy load conditions more than two such vertically extending support sections may be advisable.

In particular said rear and intermediate support sections are formed as rear or intermediate supporting board sections extending substantially in a direction along the front face of the wall. This contributes to enhanced stability of such sections against vertical pressure and allows a comparatively inexpensive production by way of profile casting in concrete due to the overall profile-like shape of said support elements.

Figure 2:
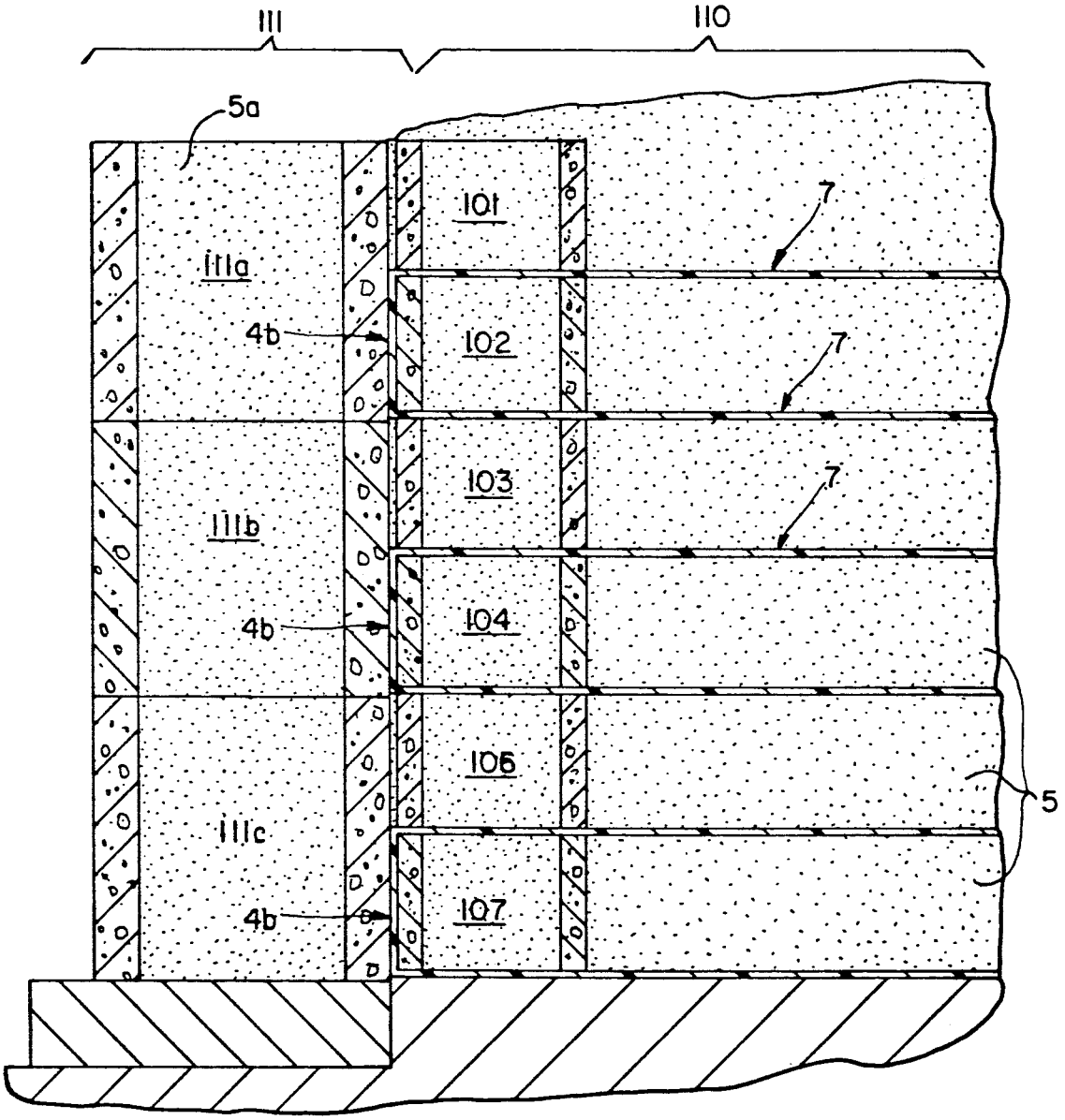
FIG. 2 is a vertical cross-sectional view of another alternate embodiment of a slope supporting wall.

FIG. 2 illustrates an example of a different scheme for covering and securing the front sections 4b of the flexible envelope material 7 defining bearing compartments within a rear support structure 110. The front assembly of said rear support structure is formed by profile beams 101 to 107 superimposed one to the other. A forepart 111 comprising a plurality of mutually superimposed auxiliary support elements 111a to 111c of box-like design, but lacking a bottom section and thus forming a vertical throughout channel filled with bulk material 5a, covers and supports the front sections of the flexible envelope material. Such forepart contributes substantially to the overall support capability of the wall.

Figure 3:
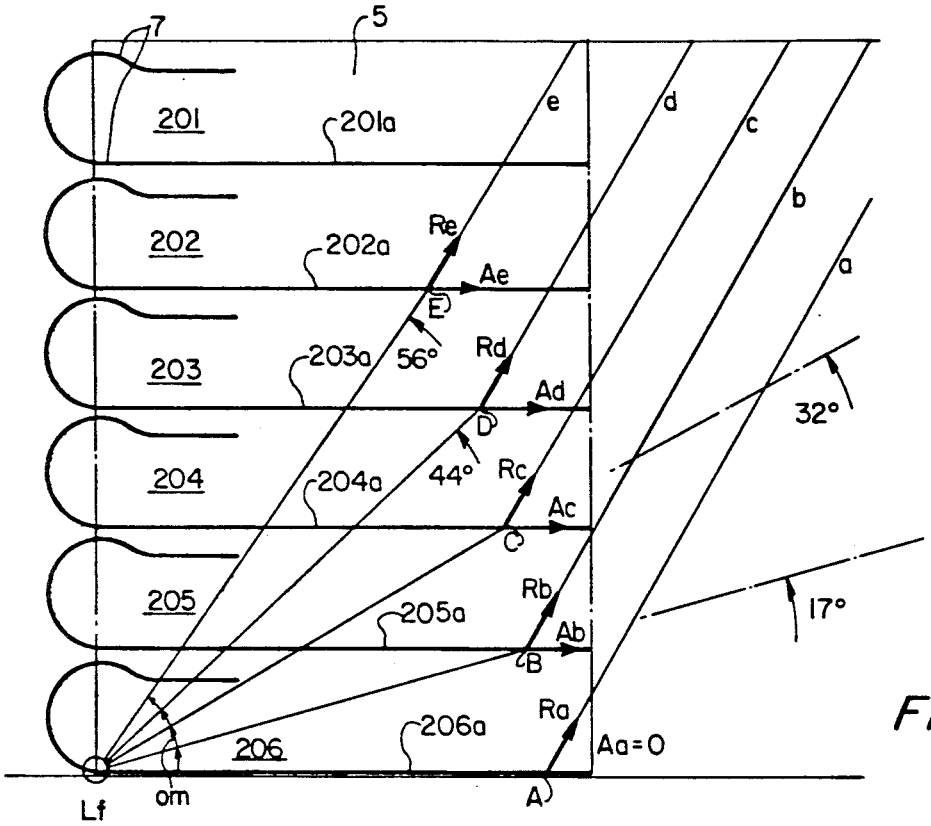
FIG. 3 is a vertical cross-sectional view of a wall with flexibly enveloped compartments within the adjacent bulk material.

FIG. 3 illustrates a bulk material wall with flexibly enveloped compartments 201 to 206 within the adjacent bulk material. Elongated anchoring sections 201a to 206a are embedded between mutually superimposed layers of bulk material substantially in horizontal planes. The stability conditions and supporting capability against earth pressure for such a structure is investigated by a method well known in the art, which method comprises calculating for each one of a representative plurality of slide-planes the sum or integral of the effective earth-pressure or slide-inducing forces in comparison with the sum or integral of the frictional holding forces within the bulk material, the frictional holding forces acting between the anchoring sections of the flexible envelope material and the adjacent bulk material and the holding tensile anchoring forces introduced through the intersections between the slide plane and said anchoring sections of the envelope material. In FIG. 3 slide planes a to e and their intersections A to E with anchoring material sections 206 to 202 have been schematically illustrated, furthermore the resultants of Ra to Re of the holding frictional forces and the anchoring forces Aa to Ae, all acting in said intersections.

As illustrated in FIG. 3, the sliding planes consist of two sections, namely firstly lower ones all starting in the common foot-line Lf and characterized by the slope angle om for each plane, and secondly upper ones starting in said intersections A to E respectively. The slope of all the last-mentioned sections of the slide-planes is the same, namely according to the inherent friction angle of the bulk material (not specifically designated in the illustration).

Figure 4:
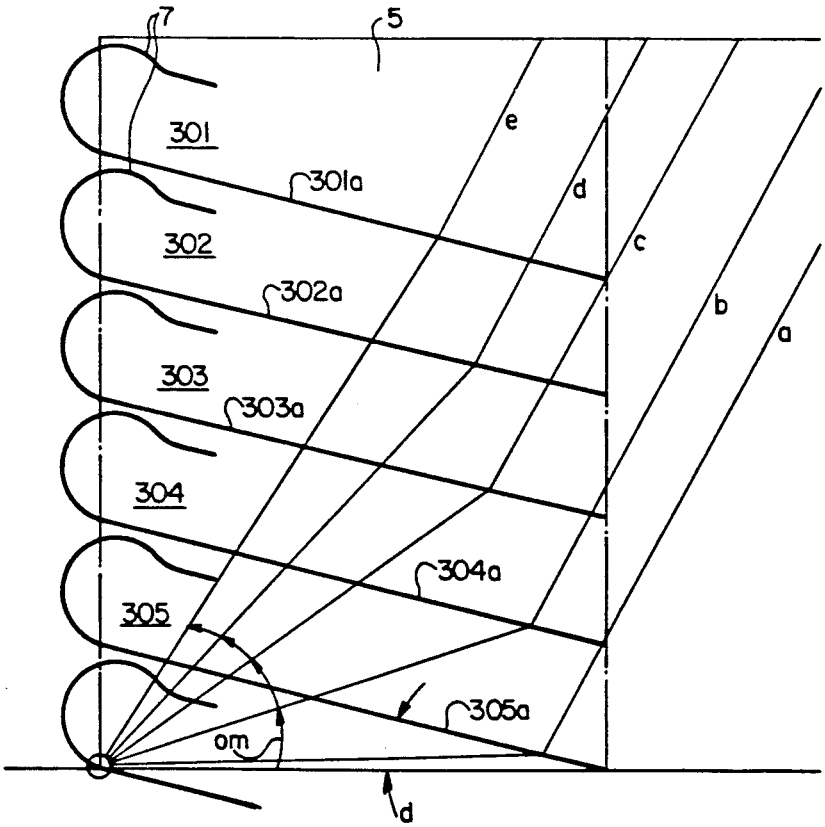
FIG. 4 is a vertical cross-sectional view of a specific wall with flexibly enveloped compartments of the present invention.

In contrast thereto, FIG. 4 shows a wall structure similar to FIG. 3 and comprising superimposed bulk material compartments 301 to 305 enveloped by flexible material 7, however, with a specifically inclined arrangement of the effective holding sections 301a to 305a thereof. Slide-planes a to e characterized by their slope angle om have been assumed in accordance with the known structure shown in FIG. 3. The same markings and designations apply as illustrated in FIG. 3, but they have been omitted for the sake of clarity.

Thorough investigations have shown that within a broad scope of applications favorable results are obtained by means of envelope-slope angles within a range from approximately 10 to 30 degrees in relation to the horizontal. Specifically for heavy load applications a slope angle within a range from approximately 18 to 24 degrees in relation to the horizontal has proved to be the best mode of operation.

Figure 5:
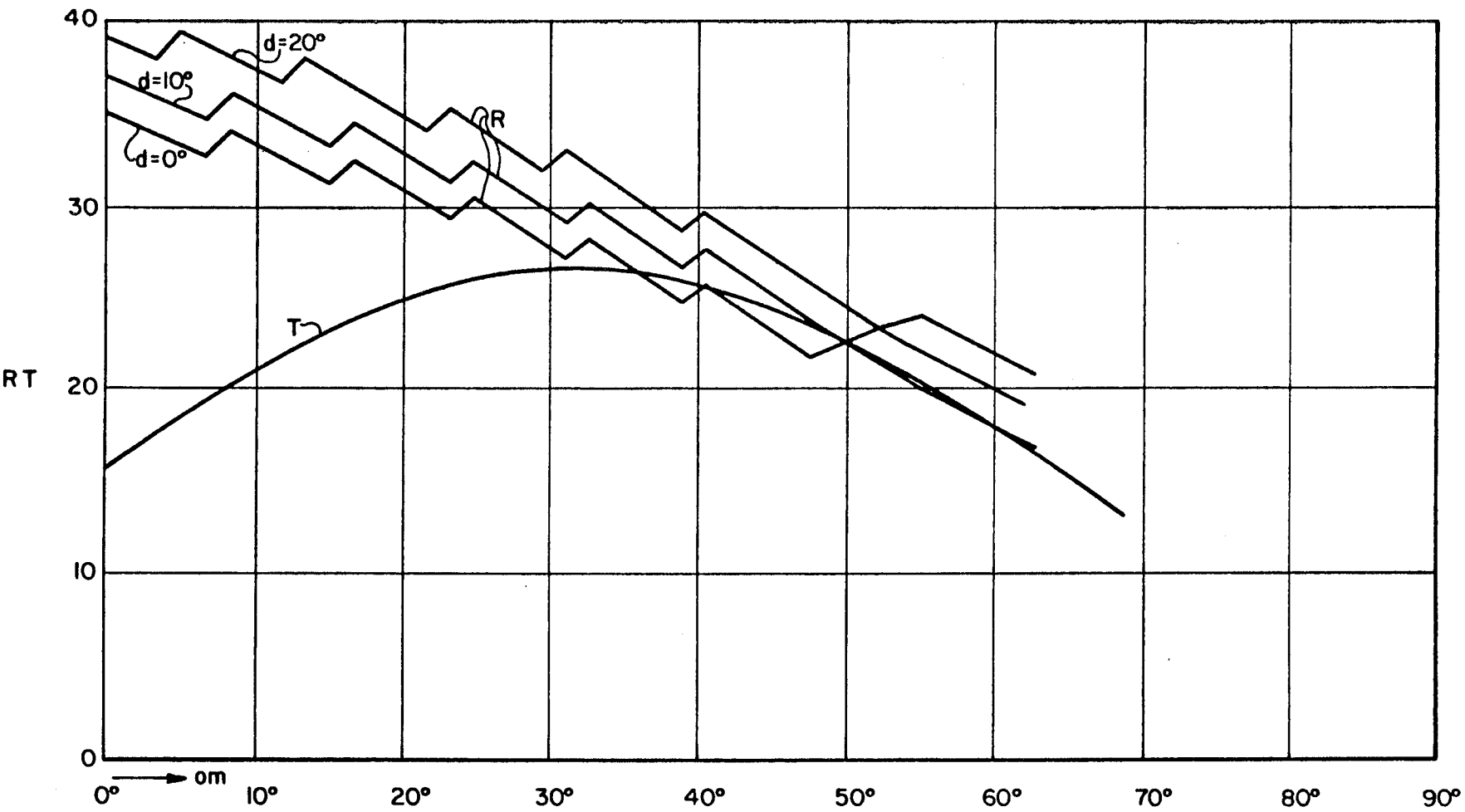
FIG. 5 is a diagram relating driving forces, retaining forces and slope angle for the wall construction of FIG. 4.

The diagram of FIG. 5 illustrates firstly by the curve T the dependency of the earth mass gravity driving force on the slope angle om of the different sliding faces within the block of earth, as is well known for any expert in the field. Furthermore, three curves of the earth retaining force being effective in the said diffrent sliding faces characterized by the corresponding slope angle om. For each of those curves the bearing section of the geotextile layers extends under a different angle d with regard to the horizontal, as depicted in FIG. 4 for the example of one specific value of d. The steps of the curves R result from the increasing number of bearing geotextile sections becoming effective at certain angles om in succession. Any sliding angle for which the curve R falls below the curve T represents a critical condition. Obviously, increasing values of d make it possible to obtain overall safety with the same amount of geotextile.

Figure 6:
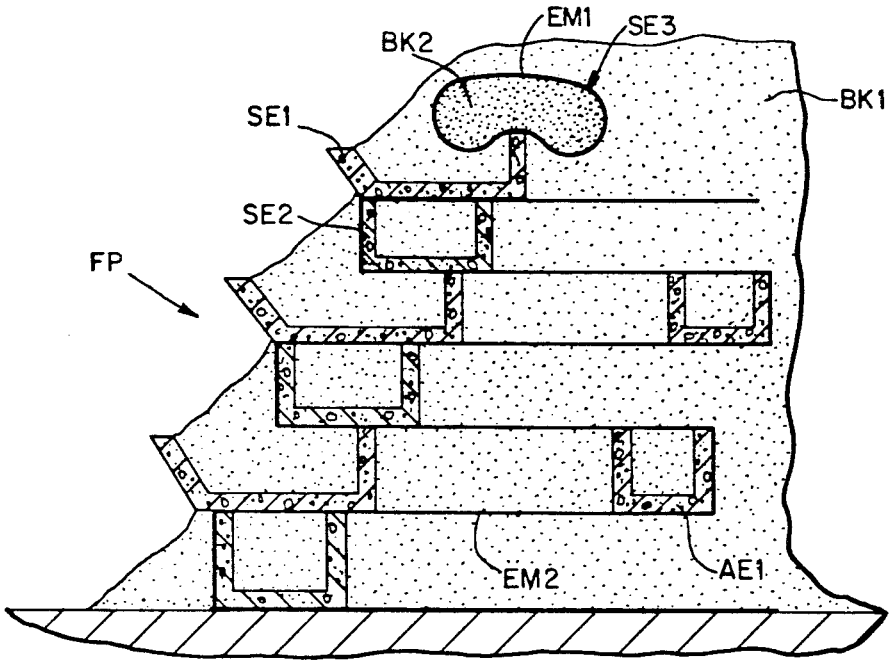
FIG. 6 is a vertical cross-sectional view of a variation of a slope supporting wall according to the invention with specific anchoring structure.

Essentially in the wall construction of FIG. 6 is firstly that the forepart FP besides concrete support elements SE1 and SE2 formed as longitudinal profile beams extending horizontally parallel to the wall plane comprises a further support element SE3 formed as a compartment filled with bulk material BK2, which may be of consistence and stability different from the main bulk material BK1 located behind the forepart FP. By using appropriate bulk material BK2, i.e. even such as fresh concrete which hardens after filling-in, such support element can contribute substantially to the stability of the forepart and the wall as a whole. Support element SE3 is defined, i.e. in the embodiment shown surrounded, by flexible envelope material EM1, which may also be of specifically appropriate nature, e.g. of permeable or broken structure so as to facilitate roots of plants to grow in. More than one such specific support element may be provided. A second essential feature in the wall of FIG. 6 is a specific anchoring structure for supporting elements SE1 and SE2 comprising further or additional flexible envelope material EM2 extending into the bulk material BK1. In the anchoring structure shown it is further important that the further or additional flexible envelope material EM2 extends in a one-piece configuration alternately around one support element SE1 or SE2, then with a comparatively long flat section into bulk material BK1, further around a specific anchoring element AE1, e.g. in the form of a longitudinal profile beam extending in parallel or under an acute angle to the wall plane, further back towards the forepart FP and here again around a further support element SE1 or SE2. The anchoring stability thus obtained with small additional expenses is a greatly enhanced one.

Figure 7:
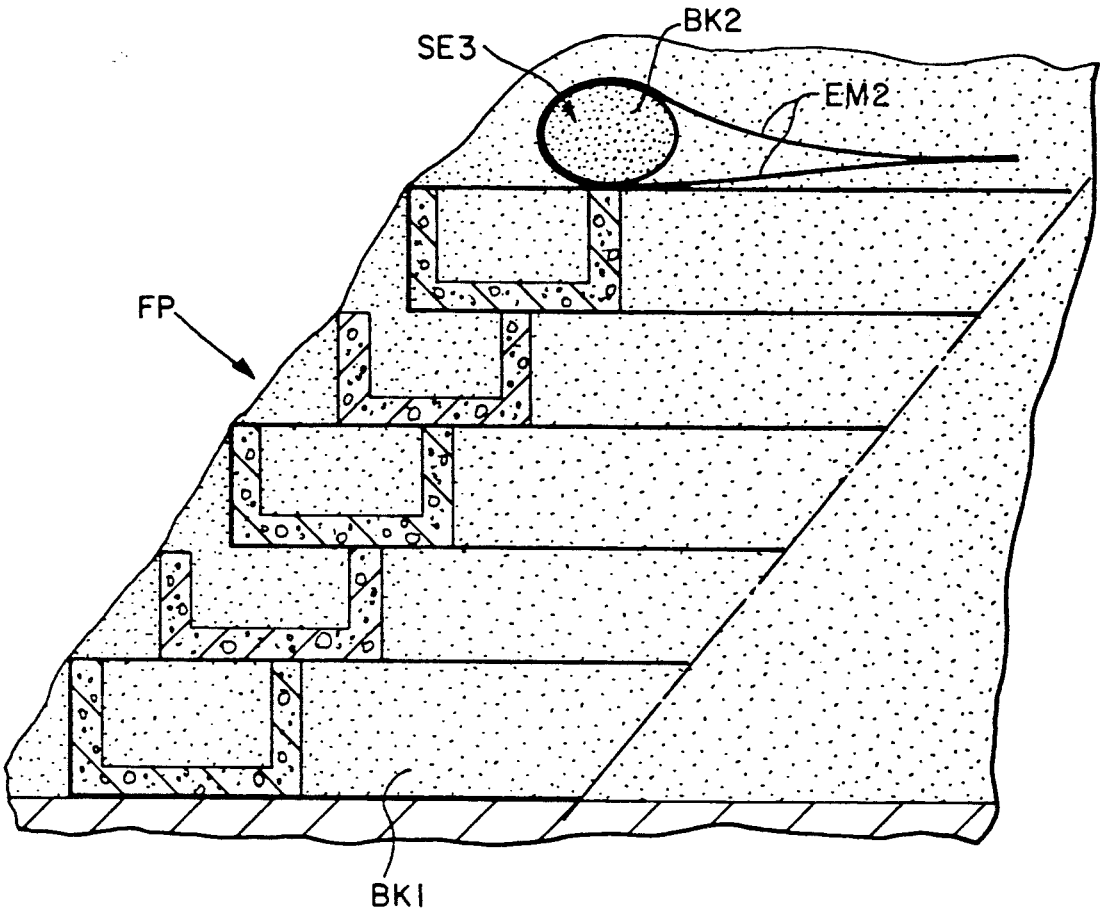
FIG. 7 is a vertical cross-sectional view of a specific wall according to the invention with a variation of a forepart anchoring structure.

The embodiment shown in FIG. 7 shows also a support element SE3 as part of the forepart FP in the form of a flexibly enveloped and bulk-material filled compartment. Here it is further shown that such support element SE3 also may contribute to the anchoring stability by means of flexible anchoring material EM2 surrounding the said support element and extending into the bulk material BK1, where it is fixed by friction or by means of anchoring elements (not shown).

Figure 8:
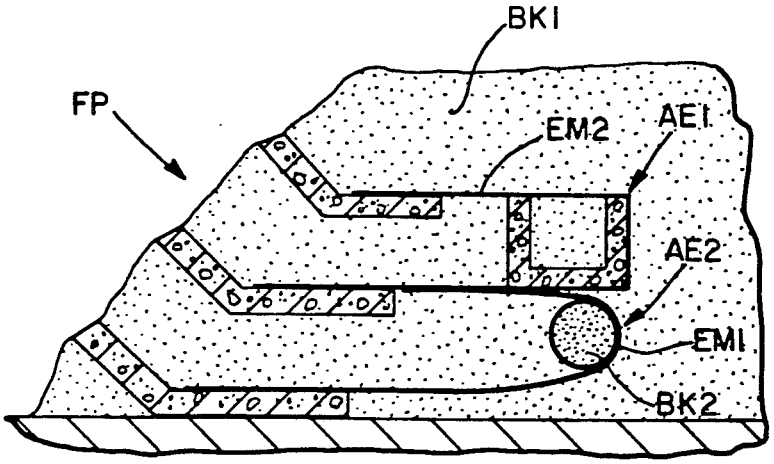
FIG. 8 is a vertical cross-sectional view of a wall variation according to the invention with additional anchoring structures.

The variation of FIG. 8 shows as a further advantageous measure according to the present invention an anchoring element AE2 formed again as a flexibly enveloped and bulk-material filled compartment embedded in the main bulk material BK1 located behind the forepart FP, e.g. in addition to a solid anchoring element AE1, This measure also may beneficially contribute to minimizing the expenses of the whole structure. In the example shown, the flexible anchoring envelope material EM2 is frictionally connected to the forepart, which in certain cases may be sufficient. Again, it is to be understood that a greater number of flexibly enveloped anchoring compartments may be provided.

The sloped construction of the forepart as shown in the last embodiments also contributes substantially to the wall stability against tilting under the earth pressure from behind the wall.

Figure 9:
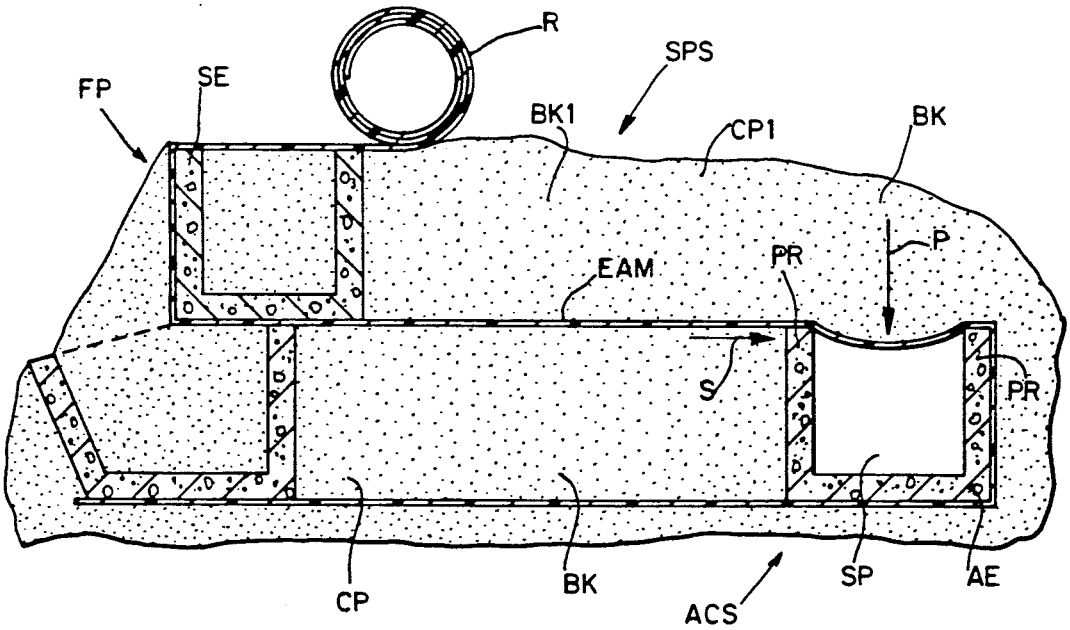
FIG. 9 is a vertical cross-sectional view of a wall comprising a specific anchoring structure with tensioned flexible anchoring members.

The embodiment of FIG. 9 shows a wall comprising a forepart FP including support elements SE in the form of profile beams, a support structure SPS including compartments CP filled with bulk material and defined partially by flexible envelope or anchoring material EAM, and an anchoring structure ACS including anchoring elements AE. The flexible envelope or anchoring material EAM extends in a one-piece configuration alternately around said support and anchoring elements as well as through bulk material BK in said compartments. In the state of construction shown, the uppermost compartment CP1 is partially completed, i.e. including its support element SE and bulk material BK1 partially filled in, but the upper layer of envelope or anchoring material EAM not yet spread or the compartment, but rather still laying on top thereof as a roll R. Anchoring element AE has two horizontally spaced projections PR, therebetween being an empty space SP with an opening oriented upwards. This opening is covered by a section of material EAM, which bears the corresponding portion of bulk material BK1. Thus material EAM in the range of said opening is tensioned by the gravity of the bulk material located on the upper side thereof. This gravity force is shown by arrow P, which causes bending of material EAM into space SP. This arrangement causes tensioning of material EAM in the range between support and anchoring elements, which has been shown by arrow S. It has to be understood that the uppermost layer of material EAM in this state is supported by the bulk material from below, but pressed on its upper side merely by the comparatively small gravity forces of the layer of bulk material BK1 so that tensioning will not be impeded. The beneficial effect of said tensioning is an exact alignment of support and anchoring elements during construction of the wall as well as an enhancement of the anchoring forces.

Figure 10:
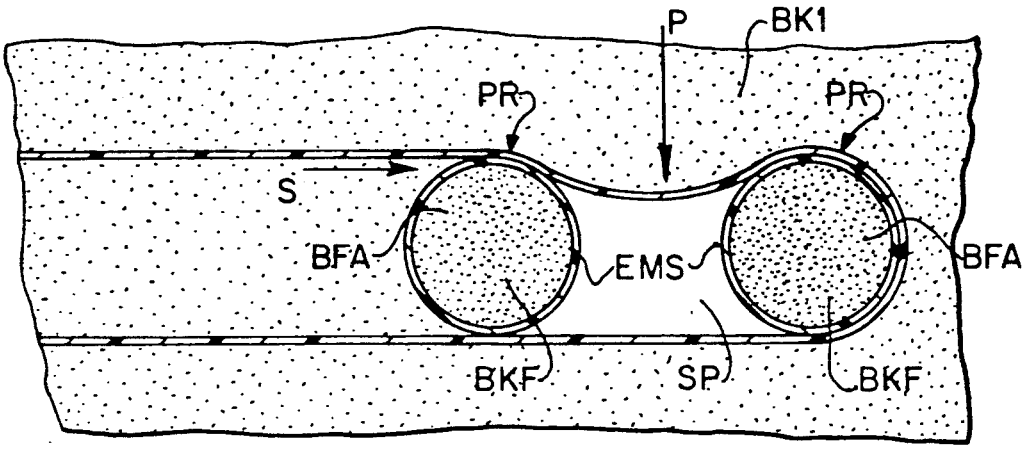
FIG. 10 shows a variation of a detail in the anchoring structure of FIG. 9.

AS illustrated in FIG. 10, in such structure said projections PR forming an empty space SP therebetween may be established with great advantage as to expenses by two or more separate anchoring elements BFA arranged with mutual distance. Furthermore, this variation shows the formation of such anchoring elements as compartments filled with special bulk material BKF and surrounded by appropriate flexible envelope material EMS, which also contributes to minimization of expenses. Particularly such special bulk material may be one which hardens or cures after filling in so as to form an at least partially solid anchoring body. The said special envelope material may then be a very cheap one. It has to be understood that support elements used in a forepart or in other parts of the wall may also be formed as such bulk-material filled, particularly hardening material-filled compartments.

Figure 11:
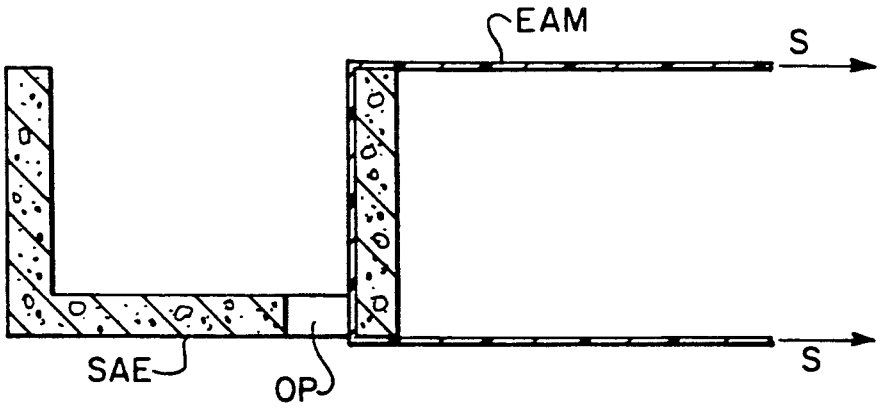
FIG. 11 shows a specific variation of a supporting or anchoring element in combination with flexible envelope or anchoring material.

FIG. 11 shows a variation of support or anchoring element SAE having an elongated opening or slot OP, through which flexible envelope or anchoring material EAM extends. This allows for enhanced force transmission illustrated by tensioning arrows S.

I claim:

1. A wall including:

a forepart (FP);

a support structure located substantially in rear of said forepart and comprising a plurality of compartments at least partially filled with bulk material;

said forepart comprising a plurality of support elements (SE1, SE2) arranged on vertically successive levels, each support element having a bottom face, a front face, and an upper face;

said compartments of said support structure being arranged one above the other, each compartment having a front face oriented towards the front of the wall, a bottom face and an upper face;

at least one of said bottom and upper faces of at least one of said compartments being defined by flexible envelope material that extends along said at least one face of said at least one compartment;

said plurality of support elements including at least first (SE2) and second (SE1) support elements, the front face of at least one of said first support elements being covered by a section of said flexible envelope material which extends out of said bulk material filling of said support structure so as to surround said at least one first support element;

at least one of said second support elements (SE1) being arranged on a level beneath at least one of said first support elements (SE2) and in supporting relationship therewith, the front face of said second support element being left free of said flexible envelope material.

2. A wall including:

a support structure comprising a plurality of compartments arranged one above the other;

said compartments containing bulk material and being at least partially defined by flexible flat envelope material (EM2);

an area of bulk material (BK1) in a rear portion of said wall;

at least one anchoring element (AE1) embedded in said bulk material (BK1); and wherein at least part of said envelope material (EM2) extends into said bulk material (BK1) and around said at least one anchoring element (AE1); and further wherein said at least one anchoring element comprises at least two projections extending upwards, between said projections there being a space having an opening oriented upwards, there being at least one layer of flexible flat envelope material extending over said opening and being in contact with said projections, on the upper side of said at least one layer of flexible envelope material there being additional material so as to tension said layer by bending thereof into said space.

3. A wall including:

a support structure comprising a plurality of compartments arranged one above the other;

said compartments containing bulk material and being at least partially defined by flexible flat envelope material (EM2);

an area of bulk material (BK1) in a rear portion of said wall;

at least one anchoring element (AE1) embedded in said bulk material (BK1); and wherein at least part of said envelope material (EM2) extends into said bulk material (BK1) and around said at least one anchoring element (AE1); and further wherein there are at least two anchoring elements arranged at a distance from each other each comprising at least one projection extending upwards, between the projections of said anchoring elements there being a space having an opening oriented upwards, there being at least one layer of flexible flat envelope material extending over said opening and being in contact with said projections, on the upper side of said at least one layer of flexible envelope material there being additional material so as to tension said layer by bending thereof into said space.

4. A wall according to claim 1, in which the front face of said second support element is shaped so as to project in direction towards the front of the wall beyond said first support element and so as to form a bearing surface for a bulk material forefilling covering at least part of the front face of said first support element.

5. A wall according to claim 1 or 4, comprising a front cover structure arranged in front of said forepart so as to shield at least the sections of said flexible envelope material which extend along the front faces of said support elements.

6. A wall according to claim 1 further including means for anchoring at least two of said support elements of said forepart to said support structure, said means for anchoring at least two of said support elements including flexible envelope material (EM2) extending as one piece around at least two of said support elements of said forepart.

7. A wall according to anyone of claims 1, 2, or 3, comprising at least one anchoring element embedded in bulk material, formed as a compartment defined at least partially by flexible flat envelope material and at least partially filled with bulk material.

8. A wall according to any one of claims 1, 2 or 3, comprising at least one anchoring element formed as a compartment defined at least partially by flexible flat envelope material and filled with bulk material capable of hardening or curing to at least a partially solid body after having been filled into said compartment.

9. A wall according to claim 2 or 3 further including:

a forepart (FP) located substantially in front of said support structure and comprising a plurality of support elements (SE1, SE2) arranged on vertically successive levels; and wherein said flexible envelope material (EM2) extends around at least one of said support elements.

10. A wall according to claim 9 in which said at least one anchoring element (AE1) is formed as a longitudinal body extending within said bulk material (BK1) at an acute angle in relation to a front plane of the wall.

11. A wall according to claim 9 in which said at least one anchoring element (AE1) is formed as a longitudinal body extending within said bulk material (BK1) parallel to a front plane of the wall.

12. A wall according to claim 9 or 10 or 11, in which said at least one anchoring element is formed as a compartment at least partially filled with bulk material and at least partially defined by flexible flat envelope material.

13. A wall according to claim 9 further including means for anchoring at least two of said support elements of said forepart to said support structure, said means for anchoring at least two of said support elements including flexible envelope material (EM2) extending as one piece around at least two of said support elements of said forepart.

* * * * *